MULTIPLE PATTERN SEWING MACHINE

BACKGROUND OF THE INVENTION

This invention relates to a multiple pattern sewing machine, particularly a sewing machine with a trouble warning device for giving a warning of trouble in the machine to the operator.

When some troubles or faults occur, in sewing machines, such as over heating of the drive motor, faulty generation of a needle position detecting signal, wire-breakage in the foot controller, etc., there is a likelihood of developing into more serious trouble, if the situation is left unnoticed by the machine operator. This may result in injury to the operator. It is therefore necessary as well as desirable that the operator be given a warning of the occurrence of a trouble as quickly as possible, so that he or she may take appropriate steps such as checking or repair.

It has been conventionally practiced that a trouble is noticed to the operator by lightening or sometimes by blinking a trouble warning lamp (alarm lamp). Disposition of such an exclusive warning lamp is likely to be accompanied by some disadvantages, such as increasing the number of component parts or requiring a difficult mounting of other operating or indicating devices which are positioned on the front surface of the machine frame which has limited space for this purpose.

Such a warning lamp must be positioned so as to be easily and most likely to be noticeable by the operator when it is lighted. It is not preferable on the other hand that such a rarely used member be disposed at the most conspicuous position of the machine from the standpoint of the general appearance thereof.

SUMMARY OF THE INVENTION

It is therefore a primary object of this invention to provide a multiple pattern sewing machine with a trouble warning device which is composed of as few component parts as possible, does not detract from the machine appearance, and is capable of reliably giving a warning of the occurrence of a trouble.

It is another object of this invention to provide a multiple pattern sewing machine with a trouble warning device which is constructed and functions to assure the operator will not overlook the indication of the occurrence of trouble.

As to this invented trouble warning device, a pattern indicator, which is disposed on the front of the machine for indicating a desired stitch pattern selected from predetermined plural stitch patterns, is skilfully utilized as a combined or double-purposed device, i.e., a device for indicating a selected stitch pattern and the occurrence of trouble as well.

The pattern indicator should be primarily disposed at the best noticeable position, on the front, of a machine for indicating the selected pattern when the operator has selected his or her desired pattern by manipulating an operational button. It is therefore constructed and arranged to constantly indicate any one selected pattern during the operation period of the machine; and the operator looks at the indicator out of habit of confirming the selection of the desired pattern.

Characteristic feature of this invention resides in that the indicator does not indicate any one of the plural stitch patterns when some trouble has taken place in the machine. Thereby, a warning of the occurrence of a trouble is given to the operator.

This invention is applicable to a multiple pattern sewing machine having stitch forming instrumentalities, manually operable means for selecting a desired stitch pattern from among a plurality of predetermined stitch patterns, pattern displaying means on the front side of the machine for indicating each of the stitch patterns, and supplying means responsive to the operation of the manually operable means for supplying an indication signal to the pattern displaying means so as to indicate the selected stitch pattern. Such a sewing machine should have detecting means for detecting occurrence of trouble in the machine and generating a trouble signal and interrupting means responsive to the trouble signal for interrupting the supply of the indication signal to the pattern displaying means, and the disappearance of all the stitch patterns per se functions as a warning for an operator of the occurrence of trouble.

The interrupting means preferably includes gate means disposed between the supplying means and the pattern displaying means for passing the indication signal toward the pattern displaying means, and the gate means is adapted to interrupt passage of the indication signal during the generating time of the trouble signal.

A preferable multiple pattern sewing machine of this invention comprises stitch forming instrumentalities, a manual switch for selecting a desired stitch pattern from among a plurality of predetermined stitch patterns, a plurality of light emitting diodes disposed correspondingly to the stitch patterns on the front side of the machine for indicating each of the stitch patterns, supplying means for circularly supplying indication signals of a constant frequency to the diodes during the closure of the manual switch and keeping on supplying an indication signal to the diode corresponding to the stitch pattern which is indicated while the manual switch is opened, the supplying means including a plurality of first output terminals and a second output terminal, one terminal of each of the diodes being individually connected with each of the first output terminals, the other terminals of the diodes being adapted to be connected in common with the second output terminal, a detector for detecting occurrence of trouble in the machine and generating a trouble detecting signal, and a gate circuit disposed between the second output terminal and a common connection part of the diodes for interrupting the supply of the indication signals to the diodes during the generating time of the trouble detecting signal.

As stated above, when the operator begins sewing operation, he or she confirms by watching the pattern indicator whether the selection of the desired stitch pattern has been completed. It is quite convenient and advantageous that the watch of the indicator naturally leads him or her to habitually ascertain whether a trouble is present or not. There can be no other more certain trouble warning device, because he or she can not actually ascertain whether the machine is in a prepared state to form a desired stitch pattern or not while the pattern indicator is not lighted.

In this way the overlooking by the operator of a trouble occurrence can be prevented, which naturally reduces the probability of a possible developing of the trouble into a more serious one or further an injurious one to the operator. What is important in this respect is that the effect can be realized economically and without detracting from the appearance of the machine.

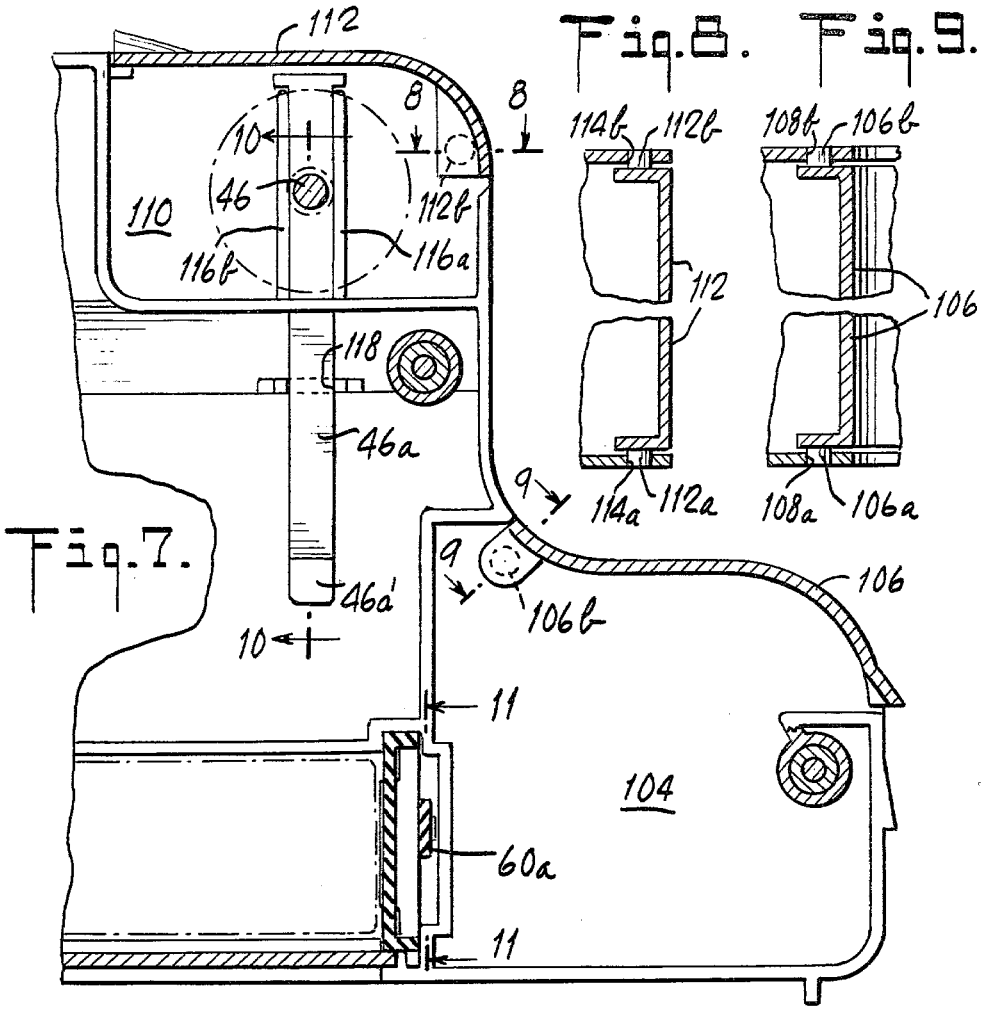
Fig.7.
Fig.8. Fig.9.
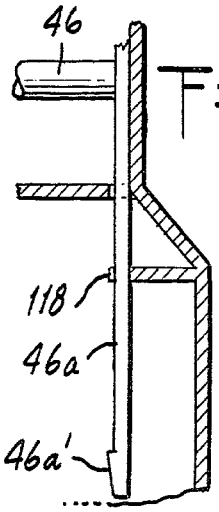
Fig.10.
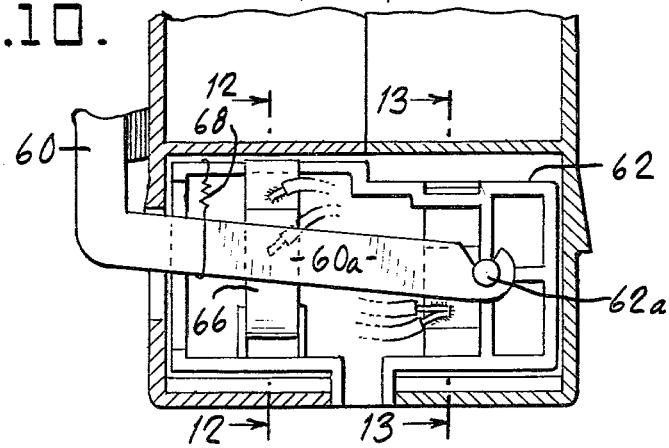
Fig.11.

Fig. 12.
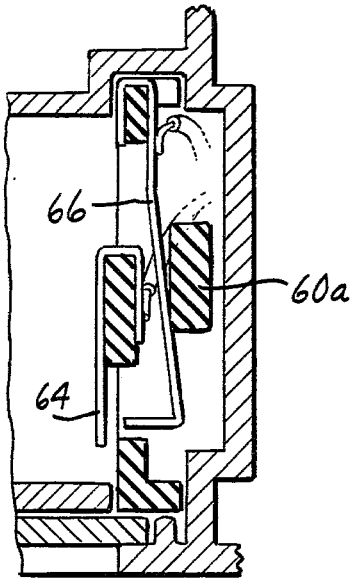
Fig. 13.
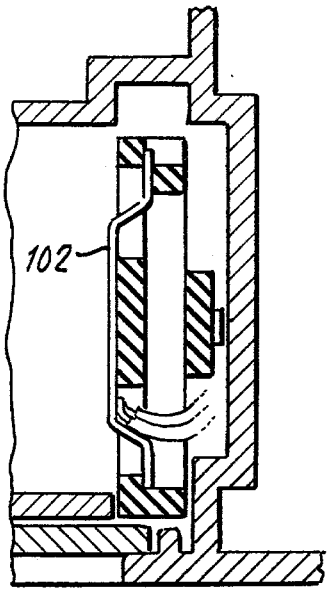
Fig. 14.
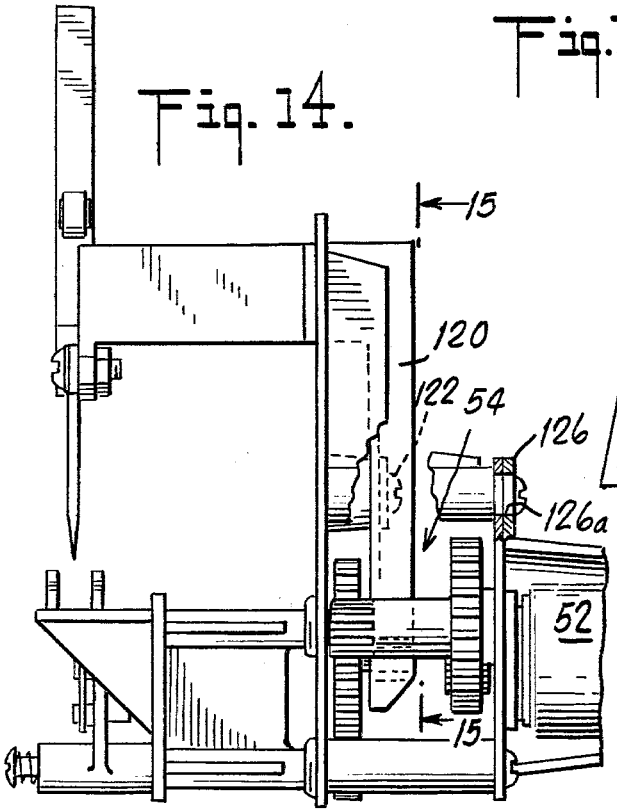
Fig. 15.
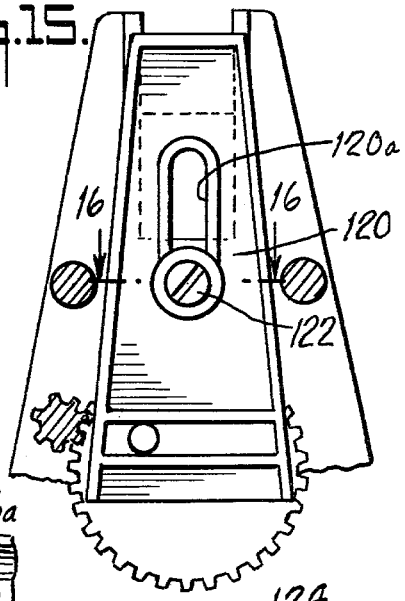
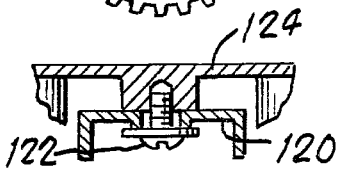
Fig. 16.

TOY ELECTRIC SEWING MACHINE

BACKGROUND AND SUMMARY OF THE INVENTION

The invention is in the field of toy sewing machines and particularly relates to inexpensive electric sewing machines which are particularly efficient and reliable to operate and inexpensive to make.

Inexpensive sewing machines have been in use for some time. One example is shown in U.S. Pat. No. 3,837,306 granted to the inventor herein. Other prior art of possible interest is cited or otherwise referred to in said patent or its prosecution history. A sewing machine of the type disclosed in said patent has been on sale for several years, as for example by Ronco, Inc. of Chicago, Ill. Said U.S. Pat. No. 3,837,306 is hereby incorporated by reference in this application.

This invention is directed to an electric sewing machine which is not only inexpensive and reliable but also particularly suited for use by children. In order to make it inexpensive to make and assemble, the invented machine comprises a particularly synergistic combination of components which are primarily made of molded plastic material and are assembled without tools or with a minimal use of tools. In order to make it particularly convenient to use, the invented machine may be provided with a number of features such as a storage compartment and a thread compartment, a movable integral light, a finger bar electric switch or a foot electric switch and others. In order to make it particularly suited for use by children, the invented machine is made with a view to minimize possible injury: for example, the clearance between the presser foot and the throat plate is deliberately made very small to keep children's fingers out of it and there are no loose parts of the machine which can easily come off.

BRIEF DESCRIPTION OF THE DRAWINGS

FIG. 7 is a partial sectional view of the back part of the sewing machine.

FIG. 8 is a partial sectional view along lines 8—8 of FIG. 7 showing the hinge connection of a thread compartment cover.

FIG. 9 is a partial sectional view along line 9—9 of FIG. 7 showing the hinge connection of a storage compartment cover.

FIG. 10 is a partial sectional view along line 10—10 of FIG. 7 showing a spool spindle and its support bar.

FIG. 11 is a sectional view along line 11—11 of FIG. 7 showing the mechanical connection of a finger bar for turning ON the sewing machine.

FIG. 12 is a sectional view along line 12—12 of FIG. 11 showing a detail of the electrical switch for turning ON the sewing machine.

FIG. 13 is a sectional view along line 13—13 of FIG. 11 showing another detail of the electrical switch.

FIG. 14 is a broken away view of a stitch forming mechanism which is a part of the sewing machine.

FIG. 15 is a partial view, along line 15—15 of FIG. 14 of the stitch forming mechanism.

FIG. 16 is a partial sectional view along line 16—16 of FIG. 15 showing a detail of an adjustment mechanism.

DETAILED DESCRIPTION

Figure 1:
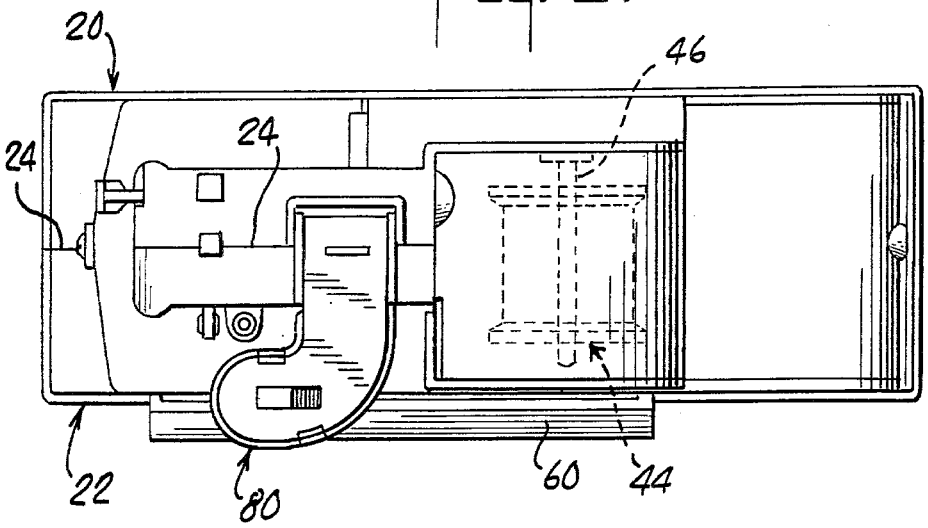
FIG. 1 is a top plan view of a toy electric sewing machine embodying the invention.
Figure 2:
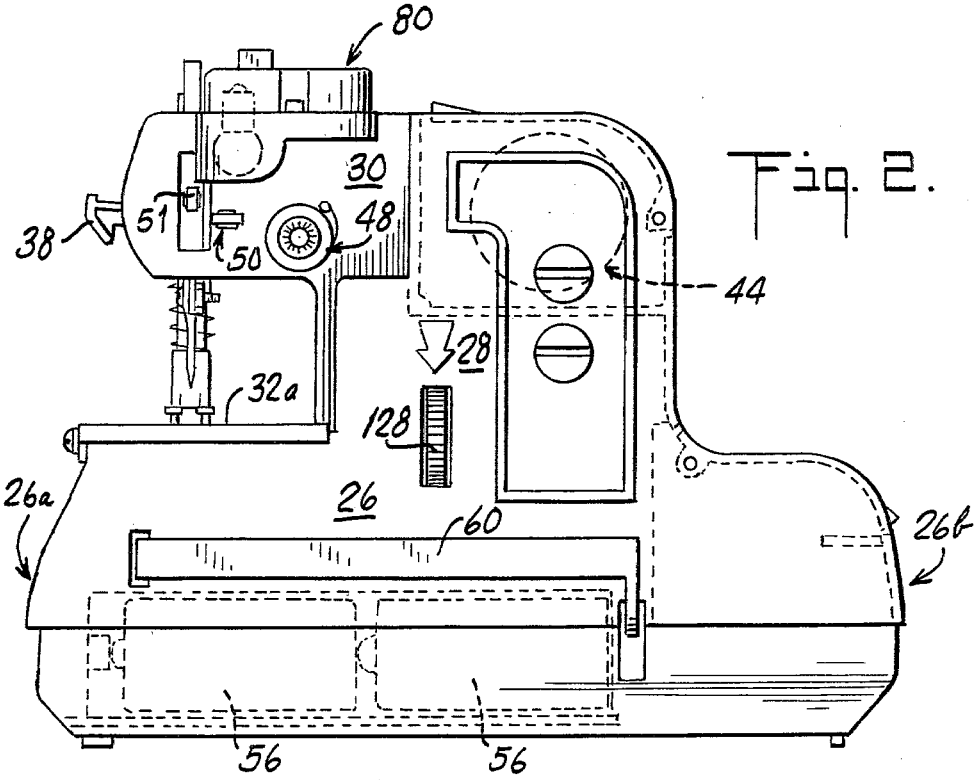
FIG. 2 is a side elevational view thereof.
Figure 3:
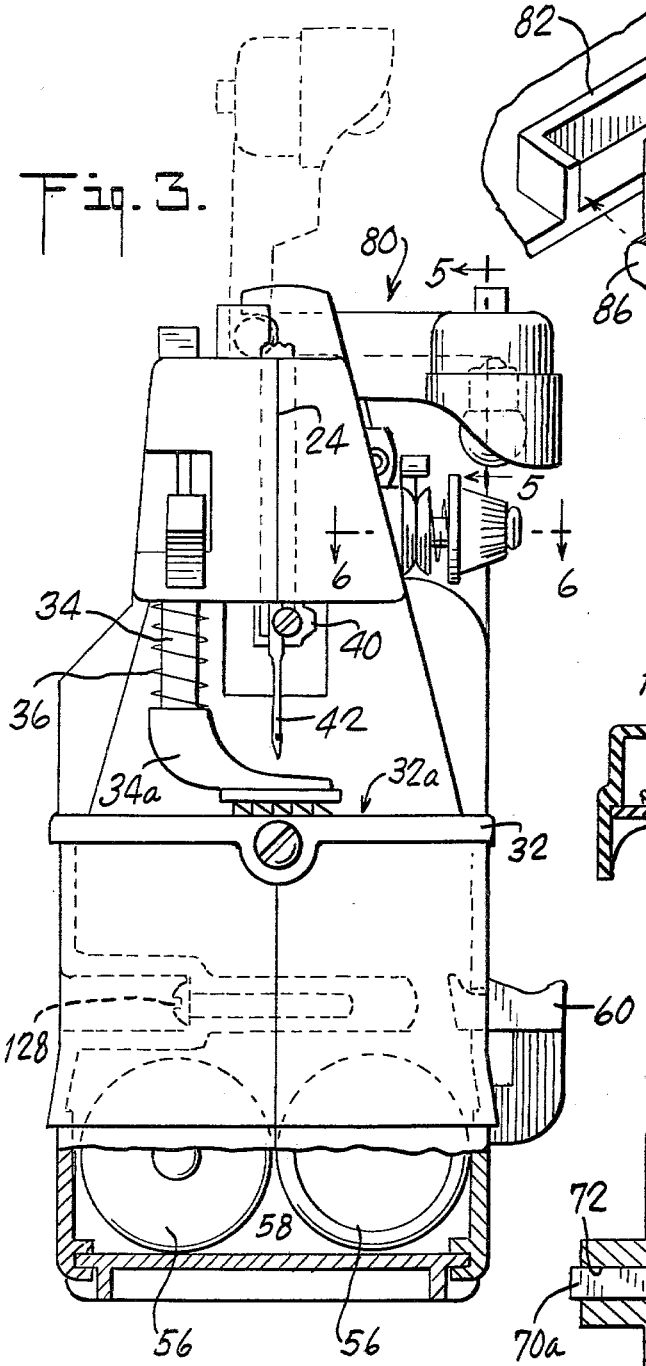
FIG. 3 is a front, partly elevational and partly sectional view thereof.
Figure 4:
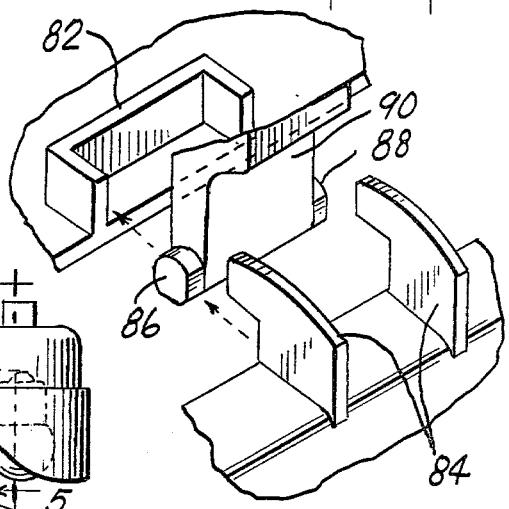
FIG. 4 is an exploded perspective view of the hinge of a light which is integral with the sewing machine.

Referring to FIGS. 1-3, an embodiment of the invented sewing machine comprises a housing formed of a left half shell 20 and a right half shell 22 which are made of molded plastic material and are joined at seams such as 24 which run generally front to back, i.e. left to right in FIGS. 1 and 2. The housing includes a base generally indicated at 26 which has a front portion generally indicated at **26*a* and a back portion generally indicated at 26*b*. A column generally indicated at 28 extends up from a portion of the base which is intermediate its front portion 26*a* and back portion 26*b*. A head generally indicated at 30 extends forwardly from the top part of the column 28 and overhangs the front portion 26*a* of the base 26. A throat plate 32 covers the top of the front portion 26*a* of the base and has a top surface 32*a* which defines a working surface of the sewing machine, i.e. the surface along which fabric is fed (the word fabric is used here to designate any sheet-like material or materials to be sewn). A presser foot rod 34 extends through the head 30 and down from it and has a presser foot 34*a* at its bottom end. The presser foot and rod are biased downwardly, toward a sewing position, by a compression spring 36. In the sewing position the presser foot 34*a* presses against the working surface 32*a*, or against any fabric which is between the working surface and the presser foot. The presser foot is movable to an up position (not shown) in which it clears the working surface 32*a* by a clearance sufficient to freely insert fabric but not the fingers of a user between the working surface and the presser foot (for example, the clearance may be ¼" or less). The presser foot may be locked in its up position by means of a lever 38** in the manner explained in said U.S. Pat. No. 3,837,306.

The machine also includes a stitch forming mechanism including a needle rod 40 mounted in the head 30 for reciprocating up and down and an eyed needle 42 depending from the needle rod and movable therewith in said reciprocating movement up and away from the working surface **32*a* and down and into the working surface. Thread is fed to the needle from a spool such as at 44 mounted on a spool spindle 46. The thread from the spool 44 passes through a tension control generally indicated at 48, then through an eyelet 50 affixed to the housing and an eyelet 51 affixed to and moving with the needle support rod 40, and then goes to the needle 42. There are loop forming means, such as those disclosed in said U.S. Pat. No. 3,837,306, which are movable cooperatively with the needle to form stitch loops therewith, such as chain stitch loops, and there are means for feeding fabric along the working surface 32*a* when the presser foot 34*a* is in its sewing position, such as the feed dogs discussed in the same U.S. patent. The machine also includes means for driving the needle, the loop forming means and the feeding means in synchronism with each other to feed the fabric along the working surface 32*a* while forming stitches thereon. The driving means include an electric motor 52 (FIG. 14**)

mounted inside the housing, gearing means generally indicated at 54 and also mounted inside the housing to transmit power from the motor to the needle, the loop forming means and the feeding means to move them in synchronism with each other and to thereby move the fabric along the working surface while forming stitches thereon. In addition there is an electric power source, such as batteries 56 enclosed in a battery compartment 58 formed in the housing, and there are means for selectively connecting electrically the motor to the power supply, to thereby energize the motor and operate the sewing machine, which may comprise a finger bar 60 operating an electrical switch to be described below or may comprise a foot switch which may be instead of or in addition to the switch operated by the finger bar 60.

The finger bar 60 is mounted on the housing to extend front to back along the outside of one of the shells forming the housing, in this case the right hand shell, and extends along at least a major part of the front portion 26*a* of the base. By means described in more detail below the finger bar 60 is biased toward an OFF position in which it is shown, but is movable by a downward force exerted on it by a user toward an ON position. The finger bar 60 returns to its OFF position, due to the bias, upon release of the force exerted on it by a user. There is an electrical switch mechanically coupled to the finger bar 60 and electrically coupled to the batteries 56 and the motor 52 to electrically connect the motor to the power supply and thereby energize the motor while the finger bar 60 is held by a user in its ON position against the bias thereof. As seen in FIGS. 11–13, the electrical switch includes a plate generally indicated at 62 on which there is mounted a fixed contact 64 and a leaf spring contact 66. The contacts 64 and 66 are the opposite ends of a circuit which includes a series connection of the batteries 56 and the motor 52. The contacts are normally in the position illustrated in FIG. 12, i.e. out of electrical contact with each other, but can be brought in electrical contact with each other, thereby closing the circuit and energizing the motor 52 by downward movement (as seen in FIG. 12) of a lever 60*a* which extends into the housing from the finger bar 60 and is pivoted at a boss 62*a* formed integrally with the switch plate 62. When the finger bar 60 is pressed down and the lever 60*a* moves downwardly as seen in FIG. 12, it slides relative to the leaf spring contact 66 and pushes the lower part of the leaf spring contact 66 to the left as seen in FIG. 12 and into electrical contact with the fixed contact 64. It is noted that the leaf spring contact 66 is formed in the shape of a clip at its upper end (as seen in FIG. 12) so that it can be snap-mounted on the switch plate 62 without the use of tools and that the fixed contact 64 is similarly formed in the shape of a clip at its upper end so that it can be similarly snap-mounted by hand on a suitable molded portion of the switch plate 62. Wires for suitable electrical connections may be pre-welded on the contacts 64 and 66. The leaf spring contact 66 may have sufficient resiliency to bias the lever 60*a*, and thereby the finger bar 60, up to the OFF position of the finger bar. If the resiliency of the contact 66 is however insufficient then a supplemental biasing means may be used, such as a tension spring 68 clipped onto the switch plate 62 at its upper end (FIG. 11) and clipped around the lever 60*a* at its lower end.

Figure 6:
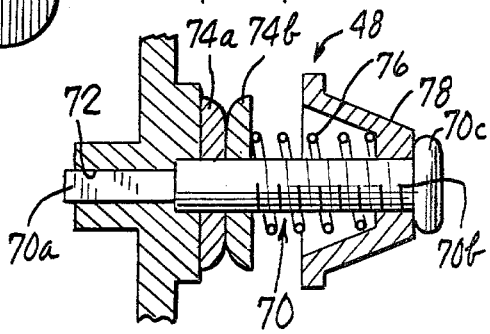
FIG. 6 is a partial sectional view along lines 6—6 of FIG. 3 showing a tension control.

The thread feeding means of the sewing machine includes a tension control generally indicated at 48 which regulates the tension of the thread fed to the needle. The tension control 48 is shown in greater detail in FIGS. 3 and 6. It comprises a stem 70 which has a rectangular cross-section front end 70*a* friction fitted in a matching opening in the head 30 of the housing so as to remain fixed with respect to the housing and has a threaded back portion 70*b* terminating in a head 70*c*. A pair of facing pressure plates 74*a* and 74*b*, between which the thread runs before it reaches the needle, are placed on the stem 70 and are biased toward each other by a compression spring 76. The force which the spring 76 exerts in pressing the pressure plates 74*a* and 74*b* against each other is regulated by a knob 78 threaded on the stem 70 to be moved relative to the housing by rotating it around the fixed stem 70. It is kept on the stem 70 by means of the stem head 70*c*. The portion 70*a* may have an arrowhead (not shown) to retain it secured to the housing once it is inserted in the opening 72.

Figure 5:
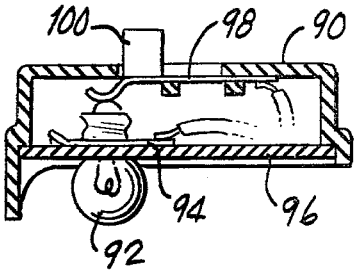
FIG. 5 is a sectional view along lines 5—5 of FIG. 3 showing the integral light.

The sewing machine may include an integral electric light generally indicated at 80 which is mounted on the head 30 and moves relative thereto between a sewing position (shown in solid lines) in which it is adjacent the tension control 48 and illuminates the working surface 32*a* to help a user feed fabric to the machine and otherwise operate the machine, and a threading position (shown in broken lines in FIG. 3) in which it is away from the tension control 48 and permits convenient access to it and illuminates it to facilitate threading the machine. In addition, the light 80 may have a position intermediate those shown in FIG. 3. The light 80 is supported by the housing at a hinge formed by collars 82 integrally formed with the housing halfs 20 and 22 respectively and hinge pins 86 and 88 which are integrally formed with a main shell 90 of the light 80. The hinge pins 86 and 88 are suitably notched and the collars 82 and 84 are sufficiently resilient so that the light can be moved by hand between its two or three positions and may remain in each respective position when released. The light 80 includes a light bulb 92 screwed into an electrical contact 94 snap-fitted into a plate 96 which in turn snap-fits into the main shell 90. A leaf spring contact 98 is slide-mounted on the main shell 90 (as shown) and can be moved, by means of a switch button 100 affixed to contact 98, between the position shown in FIG. 5 and a position to the right thereof, so as to make or break electrical contact with the bulb 92. Suitable electric wires are pre-welded to the contacts 94 and 98. One of these wires is in turn welded to a contact plate 102 (FIG. 13) which is at all times in electrical contact with one side of a series connection of the batteries 56. The other wire is prewelded to the fixed contact 64 which is at all times in electrical contact with the other side of the series connection of the batteries. Thus, the light 80 can be turned ON, by means of the switch button 100, whether or not the motor 52 is ON to run the sewing machine.

Referring to FIGS. 1, 2 and 7–9 the back portion 26*b* of the housing base, which extends back of the column 28, is hollow and forms an open top storage compartment 104, as for sewing machine accessories such as extra spools, needles, etc. A storage compartment cover 106 is hinged to the housing near the base of the column 28 to move between a down position in which it covers the storage compartment, as shown in FIG. 7, and an up position (not shown) in which it is nearly vertical and is against the back side of the column 28, to allow convenient access to the storage compartment 104. As best seen in FIG. 9, the storage compartment cover 106 has integrally formed hinge pins 106*a* and 106*b* which fit within corresponding respective openings 108*a* and 108*b* formed in the right and left housing shells 22 and 20 respectively.

The housing column 28 includes in its upper part a hollow thread compartment 110 which is open at the top. The thread compartment cover 112 is hinged at the back side of the column 28 to move between a down position, in which it substantially covers the thread compartment but permits a thread to run from a spool in the thread compartment to the tension control 48 and thence to the needle 42, and an up position (not shown) in which it points generally up and back from the column 28. As best seen in FIG. 8, the thread compartment cover 112 has integrally formed hinge pins 112*a* and 112*b* fitting within respective openings 114*a* and 114*b* in the right and left housing shells 22 and 20 respectively.

The spool spindle 46 has a sewing position in which it is inside the thread compartment 110 but can be moved up to a loading position by opening the thread compartment cover 112 and pulling up the spindle and a spindle support rod 46*a*, which is formed integrally with the spindle 46 and rides in a track made up of facing lips 116*a* and 116*b* which are integrally formed with the left housing shell 20. The support rod 46*a* is formed with an arrowhead 46*a'* at its bottom end so that it can be inserted into the track formed by the lips 116*a* and 116*b* downwardly, and can also be inserted downwardly through a guide opening 118, also formed integrally with the half shell 20, but cannot be then removed from the housing by pulling it up (see also FIG. 10).

The gearing mechanism generally indicated at 54 (FIGS. 15–16) includes a slide 120 which is driven in a reciprocating up and down motion in a manner similar in principle to that used in the machine illustrated in said U.S. Pat. No. 3,837,306 and distributed by Ronco, Inc. The slide 120 has a slot 120*a*, and a friction control screw 122 extends through that slot and is affixed to a plate 124 which in turn is fixedly secured to the housing. It is important for the reliable operation of the sewing machine that the friction between, on the one hand, the slide plate 120 and, on the other hand, the plate 124 and the screw 122 be at the correct level. In the corresponding mechanism of the prior art sewing machine shown in said U.S. Pat. No. 3,837,306 and distributed by Ronco, Inc., as well as in the sewing machine described here, there is a mounting plate 126 which makes access to the screw 122 difficult once the gearing mechanism is assembled. In the prior art machine if it proves that the friction referred to above is not at the correct level after the sewing machine is assembled and tested, it would have been necessary to disassemble the gearing mechanism or use a special tool in order to reach the screw 122 to change that friction. In the machine described here, an important manufacturing advantage contributing to the low cost of the machine is the provision of convenient access to the screw 122 even after the gearing mechanism is assembled. In particular, the mounting plate 126 is provided with an opening 126*a* positioned and dimensioned to permit access to the screw 122 with an ordinary screw driver even after the gearing mechanism is assembled, as it must be to test the operation of the machine tested.

An important aspect of the invented sewing machine is that the molded plastic parts of which it is primarily made up assemble easily and conveniently, with a minimal use of tools, and form combinations which avoid the need for machining of parts. For example, the collar 82 mounted integrally with the half shell 20 and the collars 84 molded integrally with the half shell 22 mate when the two half shells are mated to each other, to form, together with the hinge pins 86 and 88, a hinged connection for the light 80, without any need for machining a hinge, attaching an extra hinge, or using tools. Similarly, the half shells 20 and 22 are formed when the openings discussed above for the hinge pins of the covers 106 and 112, and the covers are integrally formed with corresponding hinge pins so that the respective hinge connections of the covers are formed merely by properly positioning the covers and the half shells relative to each other and mating the half shells, without the need for machining, extra hinges or special tools. Still similarly, tension control 48 is easily assembled, without the need for machining or for special tools, by threading the knob 78 on the stem 70, threading the spring 76 and the pressure plates 74*a* and 74*b* on the same stem and then inserting the stem 70 into the opening 72 which is integrally formed in the half shell 22. All of the parts of the tension control except the compression spring 76 are of molded plastic materials. Still similarly, the switch plate 62 is made of a molded piece of plastic material and is retained in place in the housing by fitting within suitable recesses, as shown in the drawing, which recesses are integrally formed as parts of the half shells 20 and 22. Thus, no special fasteners or special tools are required to secure the switch plate 62 in place in the housing. The spool spindle 46 and its support rod 46*a* fit in the track made up of the integrally molded lips 116*a* and 116*b* again without special tools or the need for any machining of parts. As already mentioned, the contacts 64, 66 and 102 are clipped onto suitably shaped parts of the contact plate 62 and retained by virtue of their fit without the need for any fasteners or any machining of parts. Still similarly, the lever 60*a* of the finger bar 60 snap-fits onto the boss 62*a* of the switch plate 62, thus again avoiding the need for special fasterers or machining. All of the parts of the sewing machine described above are made of molded plastic material except for the needle, the several springs, the electrical parts and possibly a part of the eyelet 50 and one or two screws, such as at 128, to fasten the half shells 20 and 22 to each other. Even the screws such as 28 can be eliminated by using sonic welding or similar techniques to secure the half shells to each other.

In operation, the spool spindle and its support rod are lifted up along the support rod track so that a spool is loaded on the spool spindle. The spindle and the rod are then lowered so that the cover 112 may be closed. The thread is run from the spool to the tension control 48, where it is inserted between the pressure plates 74*a* and 74*b*, then through the eyelets 50 and 51 and through the eye of the needle 42. A particularly large spool, which may not fit on the spindle 46 in the storage compartment 110 may nevertheless be used by simply placing it with its axis upright in the thread compartment 110 and leaving the thread compartment cover 112 open. To start sewing the needle may be brought up by means of a hand crank 128 suitably coupled with the gearing 54 and fabric may be inserted between the presser foot 34*a* and the working surface 32*a* while the presser foot is in its up position. The presser foot is then lowered and the machine may be turned ON by pressing on the finger bar 60. The finger bar 60 is positioned particularly conveniently so that the user may easily press on it and thus keep the machine ON while at the same time feeding or guiding the fabric being sewn.

I claim:

1. A toy electric sewing machine comprising:

a housing formed of a left and a right molded plastic half shell joined at seams running generally front to back, said housing including a base having a front portion, a column extending up from a part of the base which is back of its front portion and a head extending forwardly from the top part of the column and overhanging said front portion of the base;

a throat plate covering the top of said front portion of the base and having a top defining a working surface;

a presser foot rod extending through the head and down from it and having a presser foot at its bottom end, said presser foot and rod being biased toward a sewing position in which the presser foot presses against the working surface but being movable up to and being lockable in an up position in which the presser foot clears the working surface by a clearance sufficient to freely insert working fabric but not the fingers of a user between the working surface and the presser foot;

a stitch forming mechanism including a needle rod mounted in the head for reciprocating up and down in the head and a needle depending from the needle rod and movable therewith in said reciprocating movement up and away from the working surface and down and into the working surface, means for feeding thread to the needle, loop forming means movable cooperatively with the needle to form stitch loops therewith, means for feeding working fabric along the working surface when the presser foot is in its sewing position, and means for driving the needle, the loop forming means and the feeding means in synchronism with each other to thereby move the working fabric along the working surface while forming stitches thereon, said driving means including an electric motor mounted inside the housing, gearing means also mounted inside the housing for transmitting power from the motor to the needle, loop forming means and feeding means and an electric power supply located at least partly underneath the column and the throat plate, and means for selectively connecting electrically the motor to the power supply to thereby selectively energize the motor and operate the sewing machine.

2. A toy electric sewing machine comprising:

a housing formed of a left and a right molded plastic half shell joined at seams running generally front to back, said housing including a base having a front portion, a column extending up from a part of the base which is back of its front portion and a head extending forwardly from the top part of the column and overhanging said front portion of the base;

a throat plate covering the top of said front portion of the base and having a top defining a working surface;

a presser foot rod extending through the head and down from it and having a presser foot at its bottom end, said presser foot and rod being biased toward a sewing position in which the presser foot presses against the working surface but being movable up to and being lockable in an up position in which the presser foot clears the working surface by a clearance sufficient to freely insert working fabric but not the fingers of a user between the working surface and the presser foot;

a stitch forming mechanism including a needle rod mounted in the head for reciprocating up and down in the head and a needle depending from the needle rod and movable therewith in said reciprocating movement up and away from the working surface and down and into the working surface, means for feeding thread to the needle, loop forming means movable cooperatively with the needle to form stitch loops therewith, means for feeding working fabric along the working surface when the presser foot is in its sewing position, and means for driving the needle, the loop forming means and the feeding means in synchronism with each other to thereby move the working fabric along the working surface while forming stitches thereon, said driving means including an electric motor mounted inside the housing, gearing means also mounted inside the housing for transmitting power from the motor to the needle, loop forming means and feeding means and an electric power source and means for selectively connecting electrically the motor to the power supply to thereby selectively energize the motor and operate the sewing machine;

wherein the means for selectively connecting the motor to the power supply comprise a finger bar mounted on said housing to extend front to back along the outside of at least a major part of one of the sides of the front portion of the base, said finger bar being biased toward an OFF position but being movable by force exerted thereon by a user toward an ON position, said finger bar returning to its OFF position, due to the bias thereof, upon release of the force exerted on it by a user, and an electrical switch mechanically coupled to the finger bar and electrically coupled to the power supply and the motor to electrically connect the motor to the power supply and thereby energize the motor while the finger bar is held by a user in its ON position against the bias thereof.

3. A toy electric sewing machine as in claim 1 in which the thread feeding means include a tension control mounted on the housing, intermediate the front and back thereof, to regulate the tension of a thread being fed to the needle, and including an integral electric light mounted on the head and movable vertically relative thereto between a sewing position, in which it is adjacent said tension control and illuminates the working surface to help a user feed working fabric to the machine and otherwise operate the machine, and a threading position in which it is away from the tension control to permit convenient access thereto and illuminates the tension control to facilitate threading the machine.

4. A toy electric sewing machine as in any of claims 1–3 in which the housing base includes a hollow back portion which extends back of the column and forms an open top storage compartment, as for sewing machine accessories, and including a storage compartment cover hinged to the housing to move between a down position in which it covers the storage compartment and an up position in which it allows convenient access to the storage compartment, and in which the housing column includes in its upper part a hollow thread compartment open at the top, and including a thread compartment cover hinged to the housing column to move between a down position, in which it substantially covers the thread compartment but permits a thread to run from a spool in the thread compartment to the tension control and thence to the needle, and an up position in which it permits convenient access to the thread compartment.

* * * * *